United States Patent [19]

Carlini

[11] 4,369,017

[45] Jan. 18, 1983

[54] CENTRIFUGAL FAN

[76] Inventor: Gerardo P. V. Carlini, Gavilan 4552, Buenos Aires, Argentina

[21] Appl. No.: 266,353

[22] Filed: May 22, 1981

[51] Int. Cl.[3] ..... F04D 27/00

[52] U.S. Cl. ..... 415/157; 415/171

[58] Field of Search ..... 415/127, 128, 108, 156, 415/171, 157

[56] References Cited

U.S. PATENT DOCUMENTS

| | | | |
|---|---|---|---|
| 2,459,815 | 12/1914 | Hammell | 415/157 |
| 4,244,685 | 1/1981 | Lantinen | 415/157 X |
| 4,265,592 | 5/1981 | Carlini | 415/157 |

FOREIGN PATENT DOCUMENTS

| | | | |
|---|---|---|---|
| 101361 | 4/1962 | Netherlands | 415/157 |
| 8000989 | 5/1980 | U.S.S.R. | 415/127 |

*Primary Examiner*—Philip R. Coe
*Assistant Examiner*—Frankie L. Stinson
*Attorney, Agent, or Firm*—Michael J. Striker

[57] ABSTRACT

The centrifugal fan includes a housing of a substantially cylindrical shape having lateral walls and provided with an inlet port located at one of the lateral walls. An impeller is supported for rotation within the housing in the area of the second lateral wall opposite to the aforementioned one wall. The centrifugal fan is provided with a partition formed as a plurality of annular telescopically engaged elements or bellows. The partition subdividing the interior of the housing into a main diffusing chamber in the area of the impeller and a diffusing antechamber in the area of the inlet port is axially displaced by control arms to thus vary the area of communication between those two chambers.

8 Claims, 6 Drawing Figures

FIG. 1
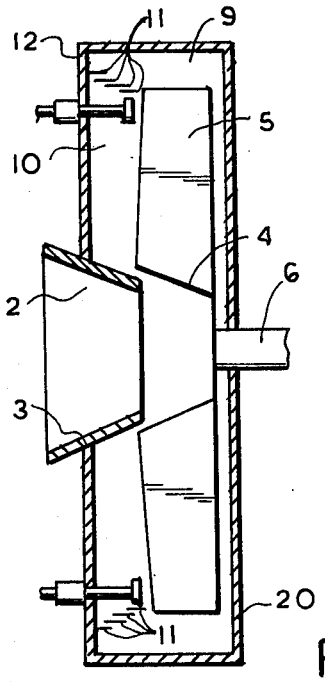
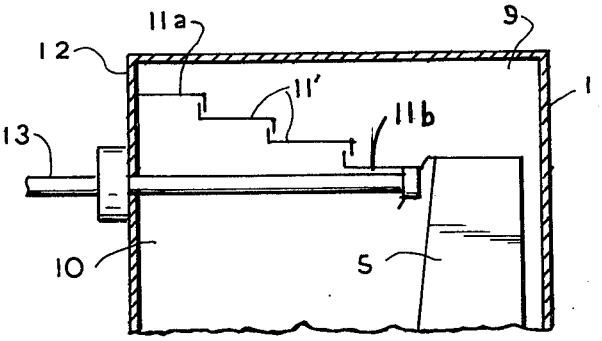
FIG. 2
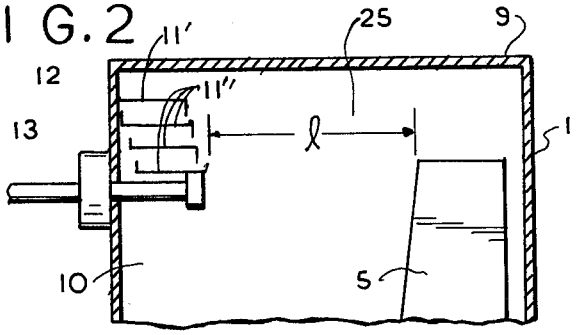
FIG. 3
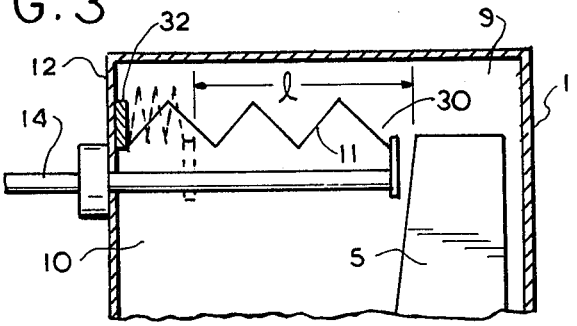
FIG. 4

CENTRIFUGAL FAN

BACKGROUND OF THE INVENTION

The present invention relates to centrifugal fans, and more particularly to a centrifugal fan of the type having an impeller driven by a motor and supported for rotation in a housing. The blades of the impeller define passages for centrifugally expelling fluid received through an inlet of the housing towards an outlet of the fan thus forming a high pressure at a required speed.

The centrifugal fans of the foregoing type are known in the art. In the known constructions of the centrifugal fans the fan is provided with a static pressure regulating antechamber which is separated from a main diffusing chamber formed in the interior of the fan housing by a space surrounding the impeller's blades.

In such constructions it is known that the operating curves of the centrifugal fans are continuous and have a uniform line, thus corresponding to given conditions of established operation output such as the desired pressure and efficiency of the fan.

The constant difficulty experienced in the known arrangements lies in obtaining a higher flexibility in the operation of the known machines.

SUMMARY OF THE INVENTION

It is an object of the invention to provide an improved centrifugal fan.

Another object of the invention is to substantially improve operation characteristics of the centrifugal fan.

Still another object of the invention is to provide a centrifugal fan whose functional parameters may be properly controlled.

These and other objects of the invention are attained by a centrifugal fan comprising a substantially cylindrical housing having a central axis and including lateral walls and an inlet port partially extended into said housing through one of said lateral walls, an impeller supported for rotation in said housing, partition means subdividing the interior of said housing into a main diffusing chamber surrounding said impeller and a diffusing antechamber surrounding said inlet port, said partition means including a substantially cylindrical partition member having a first end portion and a second end portion, said first end portion being fixedly connected to said one wall, said second end portion being spaced from said first end position and extending therefrom toward said impeller, said partition member being displaceable within said housing in a direction parallel to said central axis between a position adjacent to said impeller and a plurality of positions remote from said impeller so as to define between said one wall and said impeller an annular space of differing width which communicates said main diffusing chamber with said diffusing antechamber.

In the arrangement according to the invention, a cylindrical partition divides the inner portion of the case in two chambers one of which operates as a main diffusing chamber in the external portion of the housing, while the other, placed in the internal portion of said housing forms a real compensating chamber that connects with the former by means of a continuous opening defined by the edge of the partition and the face of the impeller, thus obtaining a remarkable increase in the efficiency of the centrifugal fans known in the art.

By provision of the partition means according to the invention the average distance between the edge of the partition and that of the impeller and consequently the communication area between the main diffusing chamber and the antechamber may be varied.

By applying the above mentioned novel means it is possible to obtain a number of advantages, that are the result of changing the traditional geometry of the operating curves of the centrifugal fans, and varying the static pressure rendered by the machine either by means of the restriction of the circulating flow or by the effect of the variation of the configuration of the partition which divides the housing of the fan, maintaining said flow constant.

The contrifugal fan may further be provided with means for displacing the partition within the housing, which means may include a plurality of control arms extending within said housing and actuated exteriorly of said housing.

Each of the control arms may have an end facing toward the impeller and connected to the aforementioned second end portion of the partition member.

The inlet port may be formed as a tubular element and may have a shape of a truncated cone.

The partition member may be formed by a plurality of annular elements adapted to telescopically engage with one another when the partition member is displaced in said direction, one of said elements remote from the impeller being connected to one wall of the housing, and one of said elements facing the impeller being connected to the control arms.

The partition member may be formed by bellows one end of which is connected to said one wall and the opposite end of which is connected to the control arms.

The partition member may be also formed by a rigid laminar element, said laminar element being connected to at least one of said control arms and extended parallel to the central axis of the housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a plan sectional view of a centrifugal fan taken along the axle of the impeller;

FIG. 2 is a partial view of the fan, showing the partition member of FIG. 1 in the extended position;

FIG. 3 is a partial view of the fan, showing the partition member of FIG. 2 in its retracted position;

FIG. 4 is a partial view of the fan, illustrating another embodiment of the partition member in accordance with the invention;

DETAILED DESCRIPTION OF THE PREFERRED EMBODIMENTS

Figure 5:
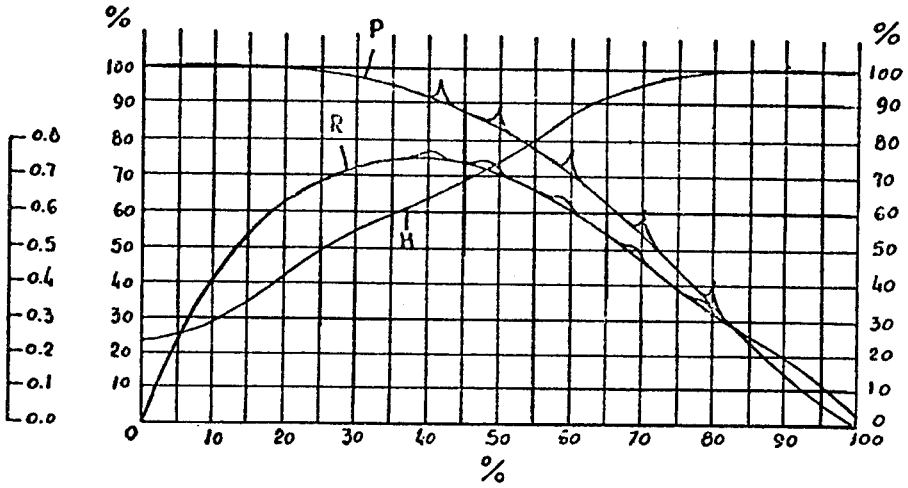
FIG. 5 is a plot of characteristic curves of the fan operating with fixed flows in the fan according to the invention.

Referring to the drawings, and first to FIGS. 1–4, the fan of the invention comprises a housing 1 having a substantially cylindrical shape defined by two lateral walls 12 and 20. Fluid is supplied into the fan through an axially extended inlet port 2 formed by a truncated cone 3. An impeller 4 is positioned within the housing 1 at the side thereof which is opposite to the inlet port 2. The impeller 4 is provided with blades or vanes 5 radially outwardly extended from a driving shaft 6. The faces of the blades 5 communicate with a main diffusing chamber 9 formed around the inner periphery of the housing 1 and separated from an antechamber 10 by means of a partition 11. The diffusing antechamber 10 results between the cone 3 and the partition 11. The drive shaft 6 is supported for rotation in a conventional manner in the lateral wall 20.

In accordance with one of the embodiments, the partition shown as 11 in FIG. 1 may be formed by a plurality of annular elements 11' as shown in FIG. 2. The annular elements 11' are provided with flanges 11''. The adjoining flanges 11'' of any two neighboring elements engage with one another when the partition 11 is in its extended position. The partition 11 may be displaced in an axial direction by means which will be explained in detail below. The annular elements 11' are arranged with one another so that when the partition retracts they form a telescopic arrangement. The annular element designated as **11*a* which is remote from the impeller 4 is secured to the wall 12 whereas the element 11*b* facing the impeller 4 faces the same at the height of the outer surfaces of the blades 5**.

The side wall 12 is provided with an opening which receives a plurality of control arms 13 extending into the interior of the housing 1. The ends of the control arms extending towards the impeller are fixedly connected to the element **11*b* whereas the ends of the control arms which project outwardly of the housing 1 serve to axially displace the arms 13 parallel to the central axis of the housing whereby any required configuration of the partition 11 may be obtained. By moving the control arms 13 the partition 11 may be axially displaced between a maximum extended position when the edge of the partition 11 is situated a short distance from the face of the impeller 4, as shown in FIG. 2, and the maximum retracted position as shown in FIG. 3 so that the distance between the edge of the partition 11 and the face of the impeller may vary between a minimum, practically zero, and a maximum which is indicated by "l". By varying the position of the partition 11 the communication area or an annular space 25 between the main diffusing chamber 9 and the antechamber 10** will be varied thus changing the respective volumes of these chambers.

FIG. 4 illustrates a modification of the partition means of the centrifugal fan according to the invention. The partition 11 may be made in the form of flexible foldable belows developed in a cylindrical shape. The edge 30 of the bellows which faces the blades 5 of the impeller 4 is secured to the ends of the control arms 14 and the edge 32 of the bellows remote from the impeller is rigidly connected to the wall 12. The arms 14 projecting outside of the housing 1 control the position of the bellows so that its position may vary from its maximum extension to its full retraction. In other words, the distance between the edge of the bellows closest to the impeller and the face of the impeller may vary practically from zero to a maximum which is indicated by "l". In order to allow the axial movement of the partition 11, maintaining the same airtight conditions of the machine such as that under consideration an airtight enclosure 10 is provided in the fan, which enclosure surrounds the entrance area of the port 2. This enclosure includes the aforementioned wall 12 through which the control arms 13 or 14 (in FIG. 4) are extended to actuate exteriorly the partition 11. By means of the arrangement under consideration the edge 30 can remain at a variable distance from the face of the impeller, said distance varying from practically zero value when the partition is fully projected toward the impeller, up to the maximum value "l" when the partition is retracted into the space defined by the airtight enclosure 10.

Alternatively, the partition means of this arrangement may be constituted by a series of rigid cylindrical laminar elements joined together one of which in the region adjacent to one of its edges is secured to the wall of the housing. The last laminar element comprises a telescopic device which is connected to at least one arm which extends parallel to the axle of the impeller and projected through the wall outside of the housing to axially displace the rigid laminar element.

The distance "l" is a function of the $$l=f(Re,\ 1/ns)$$

type, in which if the rotation speed is maintained constant it changes to $$1 = K\sqrt[4]{\frac{P^3}{\sqrt{Q}}},$$

where "P" is the power of the machine, "Q" is the flow, "K" is a constant that involves a series of parameters the values of which are the result of experience, "Re" is the number of Reynolds and "ns" is the specific speed of the rotor.

Figure 6:
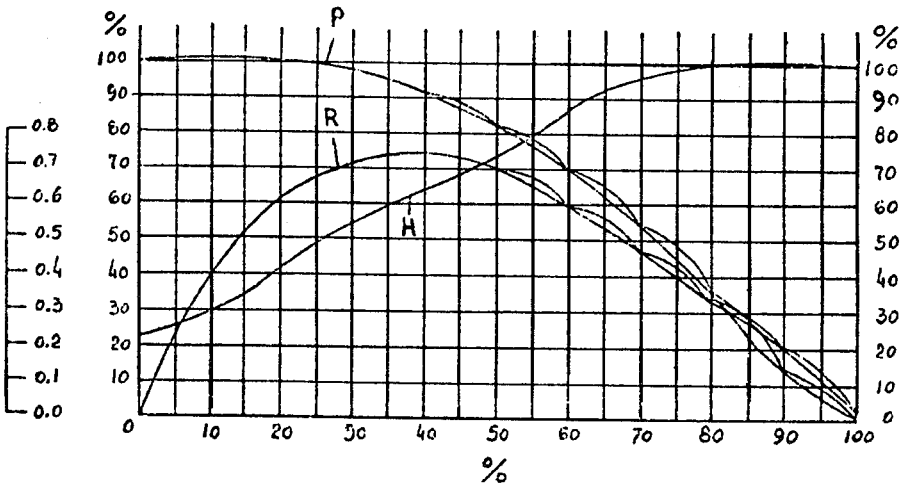
FIG. 6 is a plot of characteristic curves with a flow variation in the fan according to the invention.

In the tests on improved machines in accordance with the present invention, effected with the American measurement specifications of A.M.C.A., and carried out for a straight outlet conduct connected to a machine of a length equal to 12 times its diameter, the static pressure in the inside portion of the fan and the speed of the flow within same were measured, at a distance from the outlet of the machine equal to seven and a half diameters due to varying of the above mentioned distance "l". The results allowed to trace the curves that are illustrated in FIGS. 5 and 6. In the plot diagrams shown in FIGS. 5 and 6 the abscissa indicates the percentages of flow with reference to the maximum flow, while the ordinates indicate the measured performances and static pressure in percents of the maximum static pressure provided by the machine.

The curve indicated as P in FIGS. 5 and 6 indicates the percentage of static pressure in relation to the percentage of flow, the curve R indicating the performance in relation to the percentage of flow and curve H indicating power in percentages of maximum power of the machine as shown on the right side of the ordinate of the chart in relation to percentages of flow.

The flow regulation in the above mentioned tests was carried out by means of the operation of an outlet valve located at the end of the above mentioned conduct.

If by starting from 40% of the total flow the distance "l" is varied for a similar flow of constant outlet, a curve for pressure in the shape of a saw is obtained (as seen in FIG. 5). The curve denoted as P is drawn over the corresponding curve for the machine without the utilization of improvements of the invention, as well as a curve for the performance similar to that mentioned above, and shown in FIG. 6.

If on the other hand, the outlet flow and the distance "l" are simultaneously varied and this is repeated in each position of operation, the cascade-shape curves may be obtained as seen in FIG. 6.

It is to be pointed out that in the second example, the pressure increase obtained by the variation of distance "l", does not imply an increase of the consumed power, which indicates that same is transmitted to the fluid through the runner, taking advantage of same in a higher or lower proportion by a mere hydrodynamic effect.

By means of the improved arrangement of the present invention it has been possible to obtain a result that it was not possible to conceive in accordance with the condition of the previous art, that is to say, with one only centrifugal fan and with a constant number of revolutions it is possible to vary the geometry of the operation curves within certain limits without modifying in any way the shape and position of vanes and the mechanical arrangement of the fan.

It will be understood that each of the elements described above, or two or more together, may also find a useful application in other types of centrifugal fans differing from the types described above.

While the invention has been illustrated and described as embodied in a centrifugal fan, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifugal fan, comprising a substantially cylindrical housing having a central axis and including lateral walls and an inlet port partially extending into said housing through one of said lateral walls; an impeller supported for rotation in said housing; partition means subdividing the interior of said housing into a main diffusing chamber surrounding said impeller and a diffusing antechamber surrounding said inlet port, said partition means including a substantially cylindrical partition member having a first end portion and a second end portion, said first end portion being fixedly connected to said one wall, said second end portion being spaced from said first end portion and extending therefrom toward said impeller, said partition member being displaceable within said housing in a direction parallel to said central axis between a position adjacent to said impeller and a plurality of positions remote from said impeller so as to define between said one wall and said impeller an annular space of differing width which communicates said main diffusing chamber with said diffusing antechamber.

2. The centrifugal fan of claim 1, further including means for displacing said partition within said housing including a plurality of control arms extending within said housing and having portions projecting outside of said housing; said arms being actuated extriorly of said housing.

3. The centrifugal fan of claim 2, wherein each of said arms has an end facing toward said impeller, said second end portion of said partition being connected to said ends.

4. The centrifugal fan of claim 3, wherein said inlet port is formed by a tubular element.

5. The centrifugal fan of claim 4, wherein said tubular element has a shape of a truncated cone.

6. The centrifugal fan of claim 5, wherein said partition member is formed by a plurality of annular elements adapted to telescopically engage with one another when said partition member is displaced in said direction, one of said elements remote from said impeller being connected to said one wall, and one of said elements facing said impeller being connected to said control arms.

7. The centrifugal fan of claim 5, wherein said partition member is formed by bellows one end of which is connected to said one wall and the opposite and of which is connected to said arms.

8. The centrifugal fan of claim 5, wherein said partition member is formed by a series of rigid laminar annular elements, one of said elements including a telescopic arrangement, said arrangement being connected to at least one of said control arms and extended parallel to said central axis.

* * * * *